US011233328B2

(12) United States Patent
Samardzija et al.

(10) Patent No.: US 11,233,328 B2
(45) Date of Patent: Jan. 25, 2022

(54) DUAL-BAND ANTENNA, DEVICE AND METHOD FOR MANUFACTURING

(71) Applicant: Plume Design, Inc., Palo Alto, CA (US)

(72) Inventors: Miroslav Samardzija, Mountain View, CA (US); Brian Nam, San Jose, CA (US); Ming-Tsung Su, Palo Alto, CA (US); Liem Hieu Dinh Vo, San Jose, CA (US)

(73) Assignee: Plume Design, Inc., Palo Alto, CA (US)

( * ) Notice: Subject to any disclaimer, the term of this patent is extended or adjusted under 35 U.S.C. 154(b) by 136 days.

(21) Appl. No.: 16/565,573

(22) Filed: Sep. 10, 2019

(65) Prior Publication Data

US 2021/0075106 A1 Mar. 11, 2021

(51) Int. Cl.

| | |
|---|---|
| ***H01Q 5/30*** | (2015.01) |
| ***H01Q 5/10*** | (2015.01) |
| ***H01Q 1/24*** | (2006.01) |
| ***H01Q 5/378*** | (2015.01) |
| ***H01Q 7/00*** | (2006.01) |

(52) U.S. Cl.
CPC ..... *H01Q 5/30* (2015.01); *H01Q 1/24* (2013.01); *H01Q 5/10* (2015.01); *H01Q 5/378* (2015.01); *H01Q 7/00* (2013.01)

(58) Field of Classification Search
CPC ..... H01Q 1/243; H01Q 5/30; H01Q 5/378–5/385
See application file for complete search history.

(56) References Cited

U.S. PATENT DOCUMENTS

| | | | | |
|---|---|---|---|---|
| 6,853,197 | B1 | 2/2005 | McFarland et al. | |
| 6,961,545 | B2 | 11/2005 | Tehrani et al. | |
| 7,245,882 | B1 | 7/2007 | McFarland | |
| 7,245,893 | B1 | 7/2007 | Husted et al. | |
| 7,251,459 | B2 | 7/2007 | McFarland et al. | |
| 9,136,937 | B1 | 9/2015 | Cheng et al. | |
| 9,160,584 | B1 | 10/2015 | Kavousian et al. | |
| 9,484,631 | B1 * | 11/2016 | Napoles | H01Q 5/371 |
| 2013/0090057 | A1 | 4/2013 | Green et al. | |
| 2013/0293424 | A1 | 11/2013 | Zhu et al. | |
| 2014/0009344 | A1 | 1/2014 | Zhu et al. | |
| 2014/0009355 | A1 | 1/2014 | Samardzija et al. | |
| 2014/0112511 | A1 | 4/2014 | Corbin et al. | |
| 2014/0226572 | A1 | 8/2014 | Thota et al. | |
| 2014/0292587 | A1 * | 10/2014 | Yarga | H01Q 5/378 343/702 |

(Continued)

*Primary Examiner* — Hasan Islam
(74) *Attorney, Agent, or Firm* — Clements Bernard Baratta; Lawrence A. Baratta, Jr.; Jacob P. Beers

(57) ABSTRACT

A dual-band antenna or coupled resonators, related wireless device applications, and methods of manufacturing the same are provided. Embodiments of the antenna have resonant frequencies in a lower 2-3 GHz frequency band and a higher 5-6 GHz frequency band range. The antenna has a high frequency portion that may be configured to operate as an inverted F antenna. The high frequency element is also positioned adjacent to a nearby parasitic element. In operation, the high frequency element and the parasitic element couple together and form a current loop, or loop antenna which is configured to resonate at a low frequency band.

10 Claims, 17 Drawing Sheets

(56) References Cited

U.S. PATENT DOCUMENTS

| | | | | |
|---|---|---|---|---|
| 2014/0333504 | A1* | 11/2014 | Basirat | H01Q 1/362 343/893 |
| 2014/0340265 | A1 | 11/2014 | Vazquez et al. | |
| 2015/0099474 | A1 | 4/2015 | Yarga et al. | |
| 2015/0109167 | A1 | 4/2015 | Yarga et al. | |
| 2015/0195836 | A1 | 7/2015 | Malkin et al. | |
| 2015/0302976 | A1 | 10/2015 | Chang et al. | |
| 2015/0303568 | A1 | 10/2015 | Yarga et al. | |
| 2015/0311960 | A1 | 10/2015 | Samardzija et al. | |
| 2016/0056526 | A1 | 2/2016 | Li et al. | |
| 2016/0336643 | A1 | 11/2016 | Pascolini et al. | |
| 2017/0236776 | A1* | 8/2017 | Huynh | H01Q 21/061 257/428 |
| 2020/0227821 | A1* | 7/2020 | Wu | H01Q 1/243 |

* cited by examiner

DUAL-BAND ANTENNA, DEVICE AND METHOD FOR MANUFACTURING

FIELD OF THE DISCLOSURE

The present disclosure generally relates to antennas, devices and methods of manufacture. More particularly, the present disclosure relates to a dual band antenna for use in a wireless device, and method for manufacturing the same.

BACKGROUND OF THE DISCLOSURE

Various devices utilize antennas, or coupled antennas, for wireless communication, such as wireless Access Points (APs), streaming media devices, phones, laptops, tablets, watches, routers and the like (collectively "wireless devices"). Recently, the demand for antennas for mobile wireless applications has increased dramatically, and there are now a number of applications for wireless communications that require a wide range of frequency bands.

In conventional consumer electronic wireless devices, in order to design a single band antenna, a ground plane, such as a metallized PCD, metallic enclosure etc., and a radiating element designed to resonate at 5 GHz are needed. The radiating element can be excited by a coaxial cable, a transmission line or link. In addition, a short is sometimes needed in order to compensate for the parasitic capacitance between the radiating element and ground. When designing conventional dual-band antennas (e.g., 5 GHz for WiFi applications and 2.4 GHz for Bluetooth devices), it is necessary to grow the size of the radiating element to support the two resonances. Growing the element is typically implemented so that one element supports the lower band, and the other element supports the higher band. In growing the elements, having larger radiating elements are undesirable because they take up more volume within the devices, which in turn either makes the product bigger or alternatively reduces the volume of space for additional components that can be placed within it. When the elements grow, the overall antenna becomes bigger which makes its hard to mount on a printed circuit board (PCB). As in the surface mount technology (SMT) process, the antenna needs to balance itself on a PCB laying on a moving band. Consequently, the antenna ends up having a carrier which is an additional part and an additional cost.

FIG. 1 is a cross-sectional diagram of a conventional dual-band antenna 10 for use in wireless device applications. As shown, the dual-band antenna 10 has a low frequency portion 2 resonating at 2.4 GHz on the left and a high frequency portion 3 resonating at 5 GHz on the right. Both the low frequency portion 2 and the high frequency portion 3 are either planar inverted F (PIFA) monopole or inverted F antenna (IFA) structures. The PIFA/IFA elements 2, 3 are connected to the ground plane 5 via a short pin 4.

One of the disadvantages of the arrangement of a conventional dual band antenna 10 is the need to accommodate a length $L_P$ of the short pin 4 and the cable 6 within the space 7 between the ground plane 5 and the high and low frequency portions 2, 3. In addition, the orientation of the low frequency portion 2 decreases the available volume for other necessary components within wireless device applications. As a result, the size of any wireless device application must be increased in order to accommodate additional components. In some instances, conventional dual band antennas can take up as much as three times the volume as a conventional sing band antenna. Accordingly, there is a need for a single compact antenna having antenna radiating elements being operable in two or more frequency bands. Further, the design trend for such devices is that they be capable of fitting within compact form factors with available volume for additional device components.

BRIEF SUMMARY OF THE DISCLOSURE

Embodiments of a dual-band antenna, or coupled resonator, are provided. In one embodiment, the antenna comprises: a ground plane; a parasitic element electrically connected to the ground plane; and a high frequency element for resonating at a high frequency band and connected to the ground plane via a short. The high frequency element is capacitively coupled to the parasitic element forming a loop antenna that is adapted and configured to resonate at a low frequency band. In an embodiment, the dual-band antenna, wherein a high frequency element is configured as an inverted F antenna. In this embodiment, the inverted F antenna has a portion such that a width of the portion is greater than ¼ of a length of the portion. In an embodiment, the high frequency band is in the 5-6 GHz range, and the low frequency band is in the 2-3 GHz range.

The parasitic element may be formed from one of a shield can, heat sink, enclosure, and a stamped metallic sheet. In an embodiment the parasitic element that forms the loop antenna is part of, or grows out, of a heat sink. In an embodiment the parasitic element is molded or fabricated via a molding process. In another embodiment, the parasitic element is designed so that a first width of the parasitic element is larger at a first end relative to a second width of the parasitic element at a second end. The loop antenna may comprise a mechanical connection to the ground plane. In yet another embodiment, the parasitic element is manufactured as a separate component.

Embodiments of a wireless device having a housing are also provided. The wireless device comprises at least one device component; and at least one dual-band antenna comprising. The dual band antenna has a high frequency element adapted and configured to resonate in a high frequency band; and a parasitic element capacitively coupled to the high frequency element forming a current loop, wherein the current loop is adapted and configured to resonate at a low frequency band. The at least one device component may be one of a heatsink, a fan module, and a printed circuit board. The high frequency band may be in the 5-6 GHz range, and the low frequency band is in the 2-3 GHz range. In an embodiment, the high frequency element is configured as an inverted F antenna. In a further embodiment, a portion of the inverted F antenna has a width that is greater than ¼ of a length of the portion.

Embodiments of a method for manufacturing a wireless device are provided. In an embodiment, the method comprises: providing one or more components disposed within a housing of the wireless device; and providing at least one antenna element disposed within the housing. The at least one antenna element has a parasitic element and a high frequency element, wherein the high frequency element is adapted and configured to resonate at a high frequency band, and the high frequency element is capacitively coupled to the parasitic element forming a current loop that is adapted and configured to resonate at a low frequency band. The step of providing the parasitic element may comprise molding the parasitic element. The parasitic element may also be grown out of or provided as part of a heat sink. The step of providing the at least one antenna element may comprise obtaining or manufacturing the parasitic element as a separate component. In yet a further embodiment, the high frequency band is in the 5-6 GHz range and the lower frequency band is in the 2-3 GHz range.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

In various exemplary embodiments, the present disclosure relates to an antenna for use in wireless device applications and method(s) of manufacturing the same. The wireless devices may include applications such as streaming media devices, phones, laptops, tablets, watches, routers, etc. Embodiments of the antenna and related devices of the present invention have resonant frequencies in both a lower 2-3 GHz frequency band and a higher 5-6 GHz frequency band range. In an embodiment, the wireless devices have two specific resonance frequencies during operation, namely a low frequency band of 2.4 GHz and a high frequency band of 5 GHz.

Dual-Band Antenna Design

Figure 1:
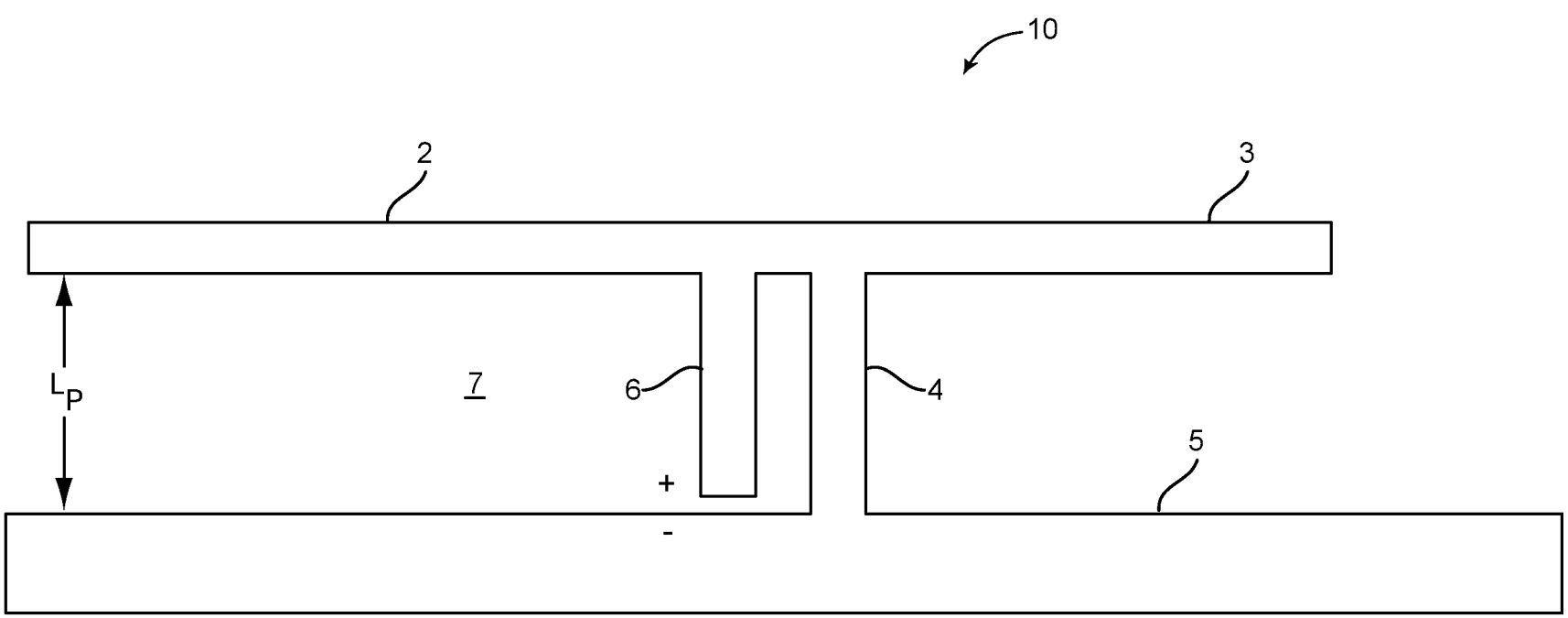
PRIOR ART FIG. 1
FIG. 1 is a cross-sectional diagram of a conventional dual-band antenna with minimal available volume for wireless device components.
Figure 2:
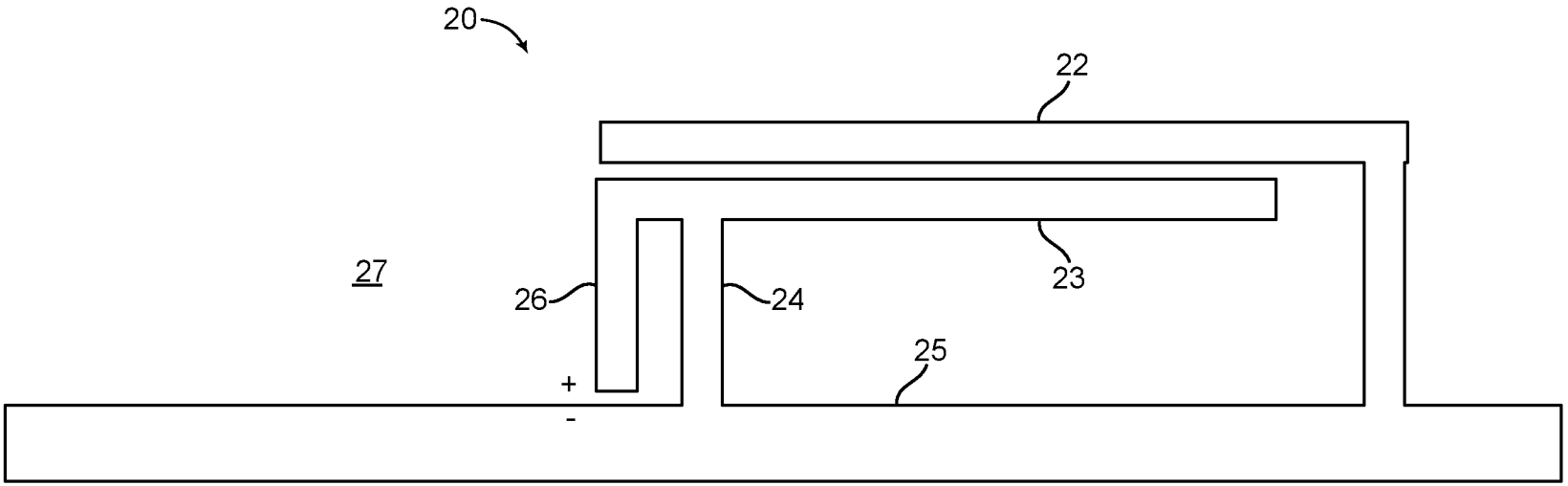
FIG. 2 is a cross-sectional block diagram of a dual-band antenna according to embodiments described herein.

FIG. 2 is a cross-sectional diagram of a dual-band antenna according to an exemplary embodiment of the present application. The antenna 20 is a dual-band antenna that has a high frequency portion 23 resonating at a high frequency band (e.g. 5 GHz). In an embodiment, the high frequency element 23 is configured to operate as an inverted F antenna. The high frequency element 23 is positioned adjacent to a nearby parasitic element 22. In operation, at about 2 GHz, the high frequency element 23 and the parasitic element 22 couple together and form a current loop, or loop antenna, which is configured to resonate at a low frequency band (e.g. 2.4 GHz). The parasitic element 22 is connected to the ground plane 25 via a short 28*a* and 28*b*. An excitation feed 26 is also connected to the high frequency element 23 at a contact point indicated by the + sign in the FIGS. It is at this point where a cable (not shown), such as a coaxial cable is electrically attached, or where the transmission or signal line on the PCB connects to the antenna 20.

Figure 3A:
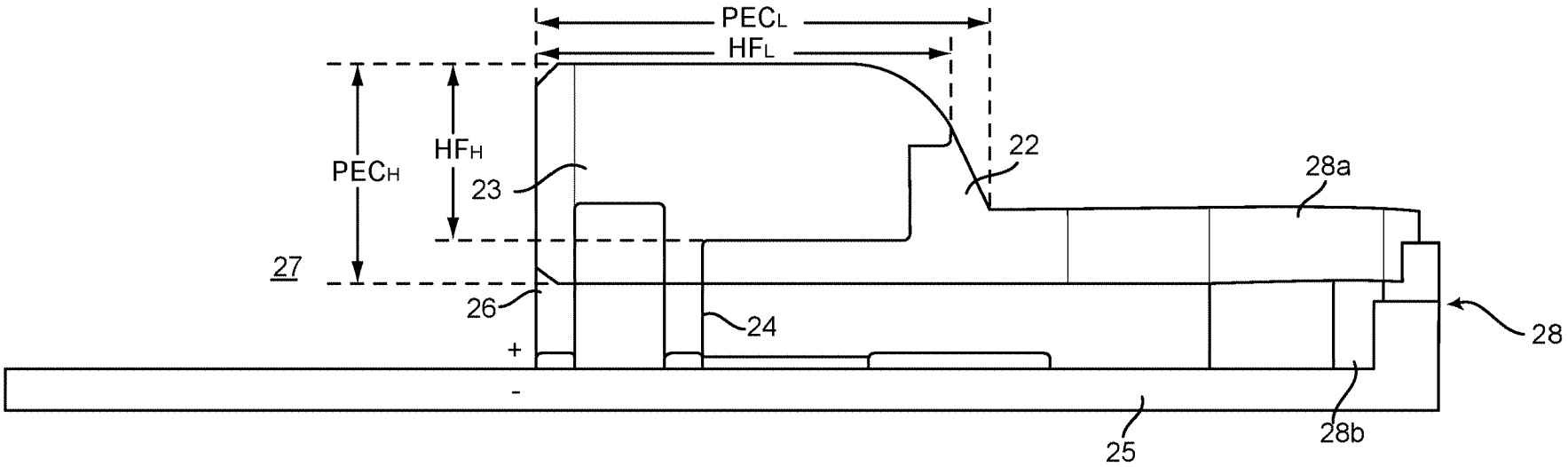
FIG. 3A is a side perspective view of the antenna of FIG. 2.
Figure 3B:
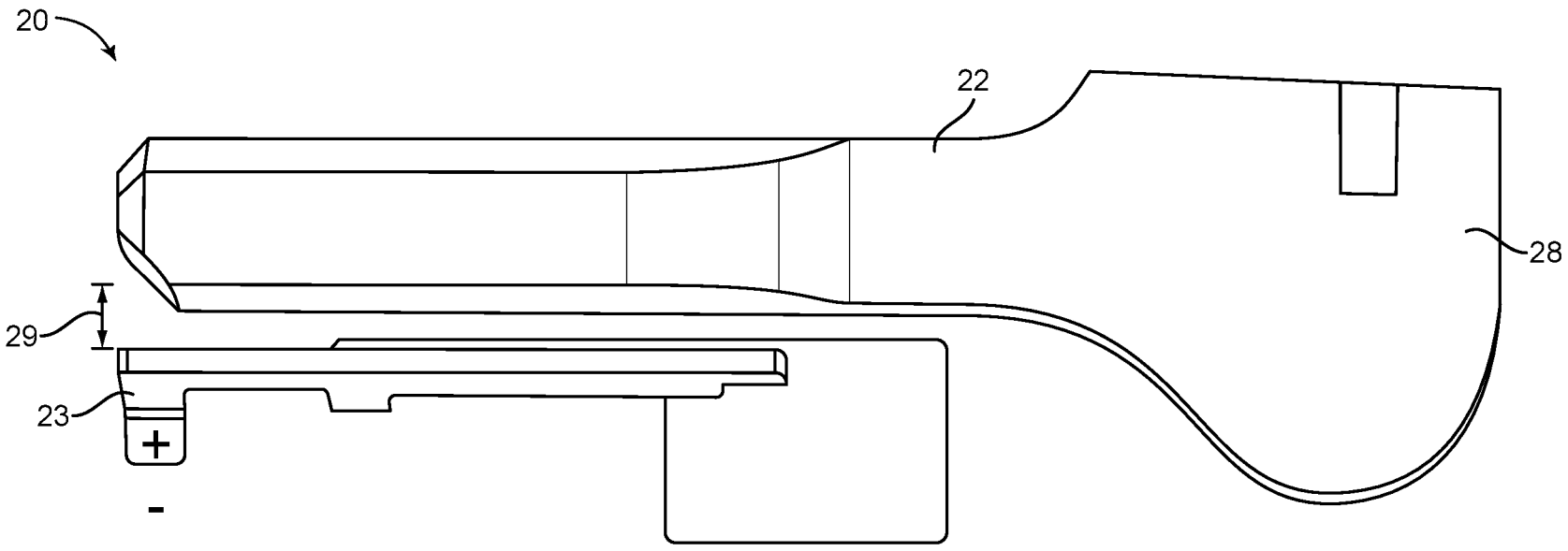
FIG. 3B is a top perspective view of the antenna of FIG. 2.

FIGS. 3A and 3B is a side and top view of the antenna 20. FIG. 3A depicts a connector 28 portion having an upper connector portion 28*a* extending from the parasitic element 22 and a lower connector portion 28*b* extending from ground plane 25. In an embodiment, the upper connector portion 28*a* and the lower connector portion 28*b* may be fastened together via various types of metallic fasteners, such as screws or rivets, to secure the antenna 20 within a wireless device (not shown). FIG. 3B illustrates the physical coupling gap 29 between the high frequency element 23 and the parasitic element 22, which creates the capacitance between the two elements. This capacitance can be adjusted in order to increase or decrease the coupling needed between the two elements 22, 23. The higher the capacitance, the higher the coupling. In addition, while the parasitic element 22 is shown as having a larger thickness relative to a high frequency element 23. The relative thicknesses can be adjusted as desired and may be based on a desired ease of manufacturing. In an embodiment, the thicknesses of each of the high frequency element 23 and the parasitic element 22 are approximately the same. The parasitic element 22 may be manufactured as a separate component and may be formed, for example, from materials such as a shield can, heat sink, enclosure, or stamped metallic sheet.

One of the benefits and advantages of the configuration of the antenna 20 as provided is that it allows for the space 27 to be utilized for various components in a wireless device application. Further, the configuration reduces the overall height of the antenna 20, and thus reduces the height of the overall antenna 20, which allows the antenna 20 to fit more compactly in smaller form factors for wireless applications.

Parasitic Element Design

As further illustrated in FIG. 3A, the coupling portion of the parasitic element 22 should overlap as much as possible with the high frequency element 23 in order to achieve maximum coupling. The dimensions of the high frequency element 23 are illustrated as a high frequency length $HF_L$ and a high frequency height $HF_H$. In an embodiment, the parasitic element coupling height $PEC_H$ relative to the parasitic element coupling length $PEC_L$ is at a ratio that is greater than or equal to 0.25. In addition, the parasitic element 22 is also designed to be long enough to form a 2.4 GHz loop. The larger the overlapping area, the larger the capacitance, which results in larger coupling, and a shorter required parasitic element 22. In an embodiment, the high frequency element 23 and the parasitic element 22 are roughly the same dimension (e.g., 12 mm by 5 mm], which together ground 25, yields a ½ wavelength loop at a resonance of 2.4 GHz.

In an embodiment, the coupling area (i.e., overlap between the parasitic element 22 and the high frequency element 23), and the length of the coupling gap 29 are each chosen to maximize coupling at 2.4 GHz.

Figure 4A:
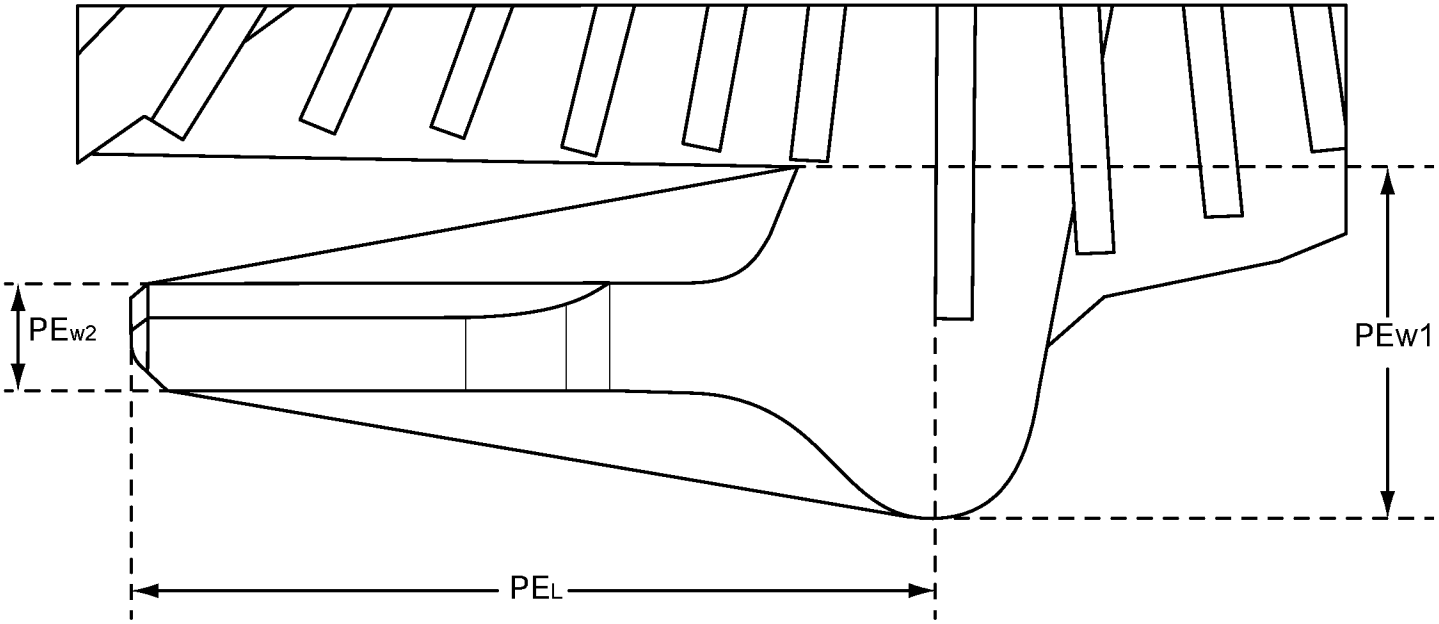
FIG. 4A is a top view of a tapered width of an embodiment of the parasitic element design.
Figure 4B:
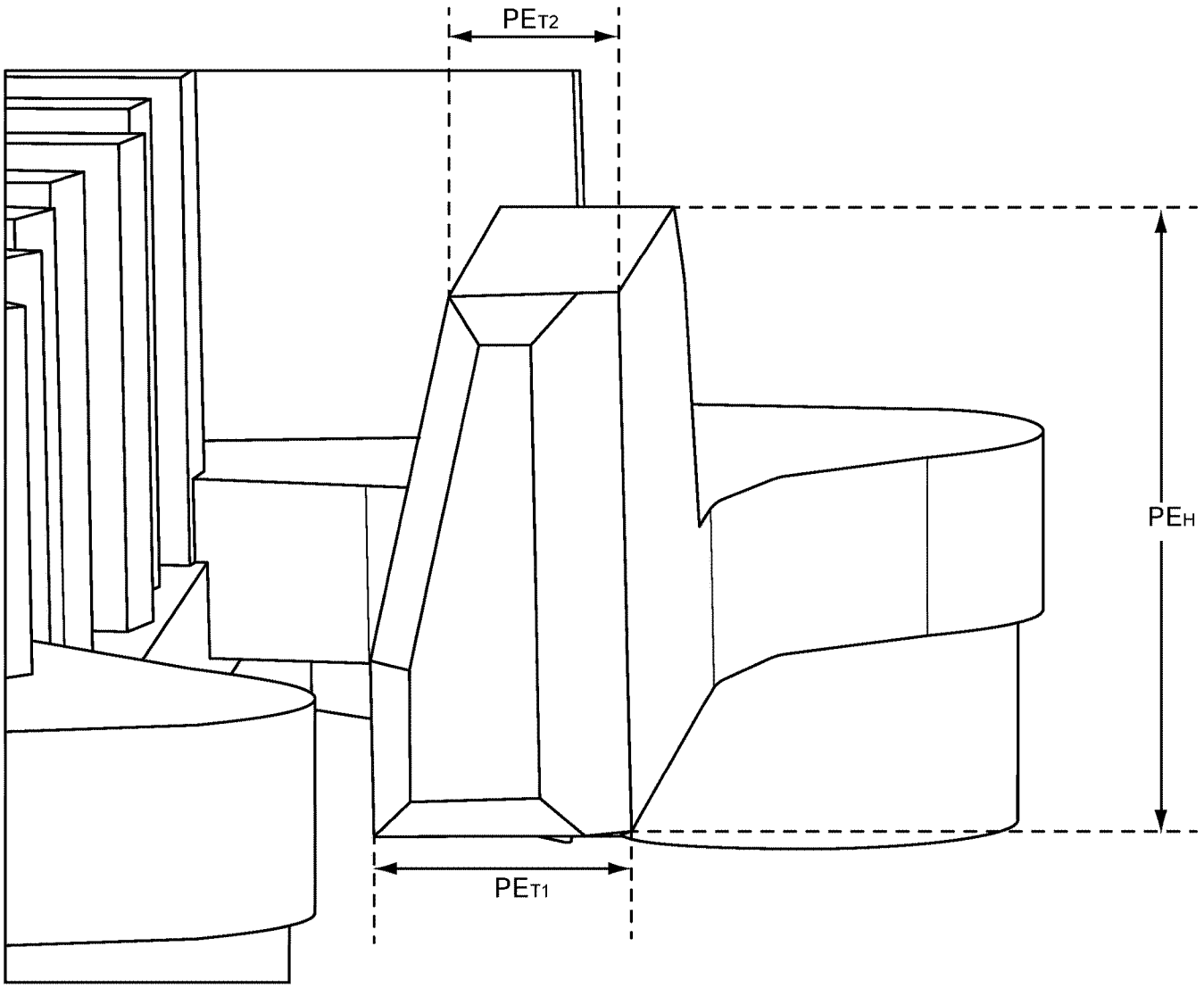
FIG. 4B is a side view of the tapered thickness of an embodiment of the parasitic element design.

The parasitic element 22 may be manufactured by a molding process. The parasitic element 22 can be molded as a separate piece that is mechanically screwed into place within the antenna 20. In manufacturing the parasitic element 22, it is important not to make it the dimensions too long in order to avoid cracking and bending during the molding and or manufacture of the overall structure of the antenna 20. FIGS. 4A-B illustrate a top and side view, respectively, of the parasitic element 22. In an embodiment illustrated in FIG. 4A, the width $PE_{W1}$ of the parasitic element 22 (along a length $PE_L$) at one end is greater than a width $PE_{W2}$ of the parasitic element 22 at the other end. Tapering the width in this way helps make the parasitic element 22 effectively wider and stronger so that it is able to sustain the stress of the manufacturing process. For example, the design illustrated in FIG. 4A has the benefit and advantage of making the parasitic element 22 stronger so that it is able to sustain a push from ejector pins coming out of the core of a mold during a molding process. Similarly, the side view shown in FIG. 4B of the embodiment illustrates a tapered design where a thickness $PE_{T1}$ is greater than a thickness $PE_{T2}$ (along a height $PE_H$). This configuration helps reduce friction between the mold used to manufacture the parasitic element 22, when it is removed in the direction of the height $PE_H$.

Figure 5A:
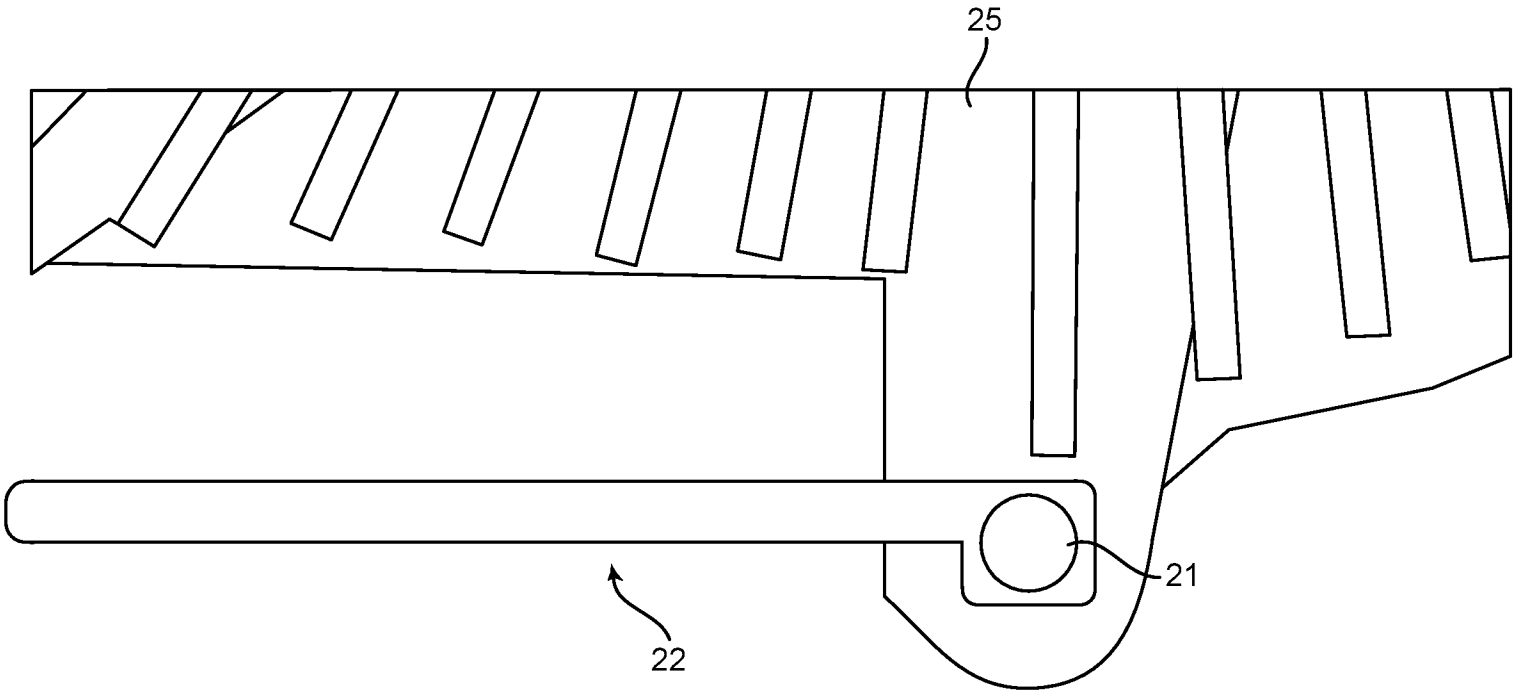
FIG. 5A is a top view of the parasitic element design as a stand-alone part of an antenna according to an embodiment of the present disclosure.
Figure 5B:
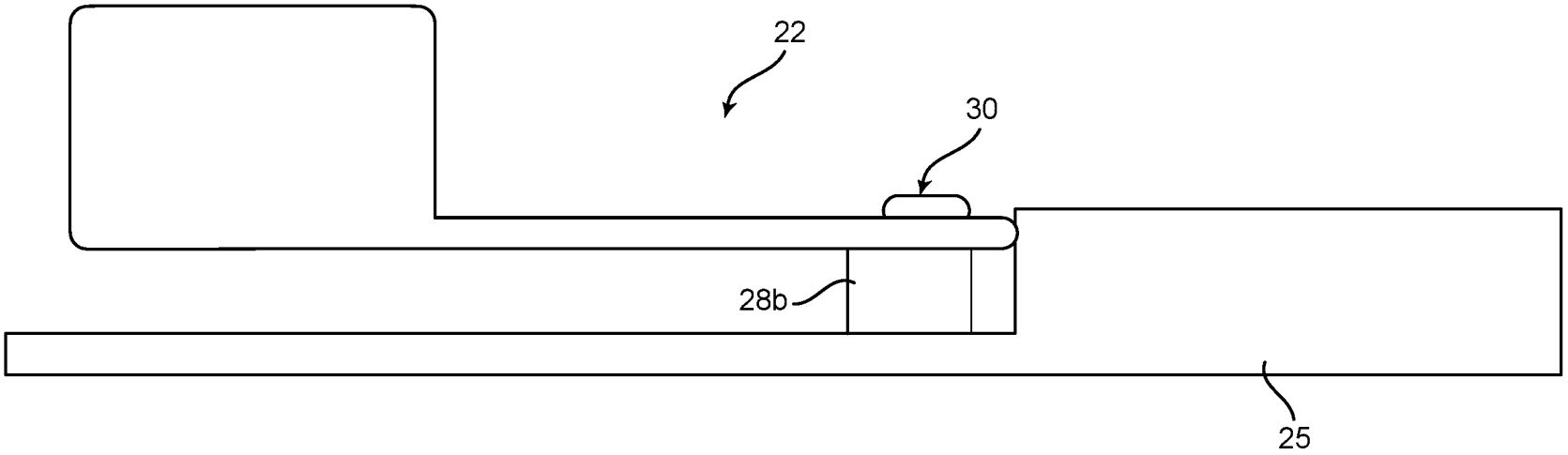
FIG. 5B is a side view of the parasitic element design as a stand-alone part of the embodiment of the antenna illustrated in FIG. 5A.

The parasitic element 22 may be manufactured as a stand-alone part, or alternatively grown out of the ground plane 25, which may also be a heat sink, for example. FIGS. 5A-5B is a top view and side view, respectively, of the design of the parasitic element 22 when designed and manufactured as a stand-alone, or separate component, of the antenna 20. As illustrated, in this embodiment, the parasitic element 22 is a made from a stamped metallic sheet that is mechanically secured, screwed or clipped to the ground plane 25. In this embodiment, the ground plane 25 may be a heatsink. Further, the parasitic element 22 may have a hole 21 punched in the metallic sheet to allow for a metal fastener 30, such as a screw, to fasten the parasitic element 22 to the ground plane 25.

Antenna Operation and Current Flow

Figure 6:
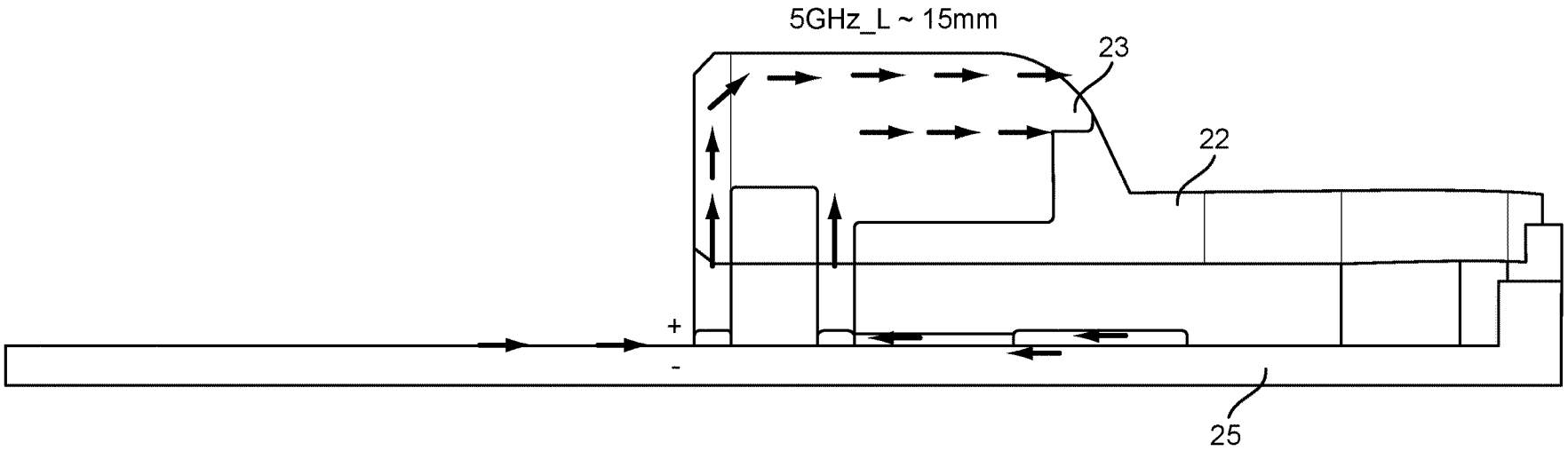
FIG. 6 is a side perspective view of the antenna of FIG. 2 illustrating the current flow when the high frequency element 23 is radiating.

FIG. 6 is a side perspective view of the antenna element 20 illustrating the current flow at a high frequency band, which occurs when the high frequency element 23 is radiating. The high frequency element 23 is approximately ¼ of the wavelength of 15 mm. The relative strength of the current flow is illustrated by the arrows such that the longer solid arrows depict stronger currents and the shorter arrows depict weaker currents. At 5 GHz, the parasitic element 22 operates as an extension of the ground plane 25 and does not substantially contribute to radiation of the high frequency element 23.

Figure 7A:
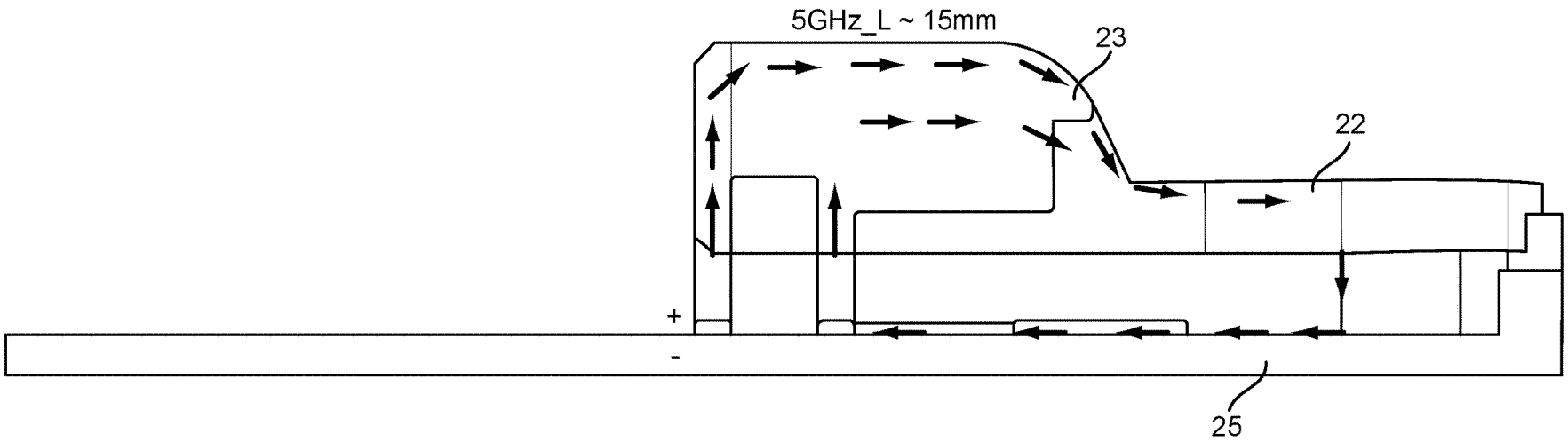
FIG. 7A is a side perspective view of the antenna of FIG. 2 illustrating the current flow when both the high frequency element and low frequency loop are radiating.
Figure 7B:
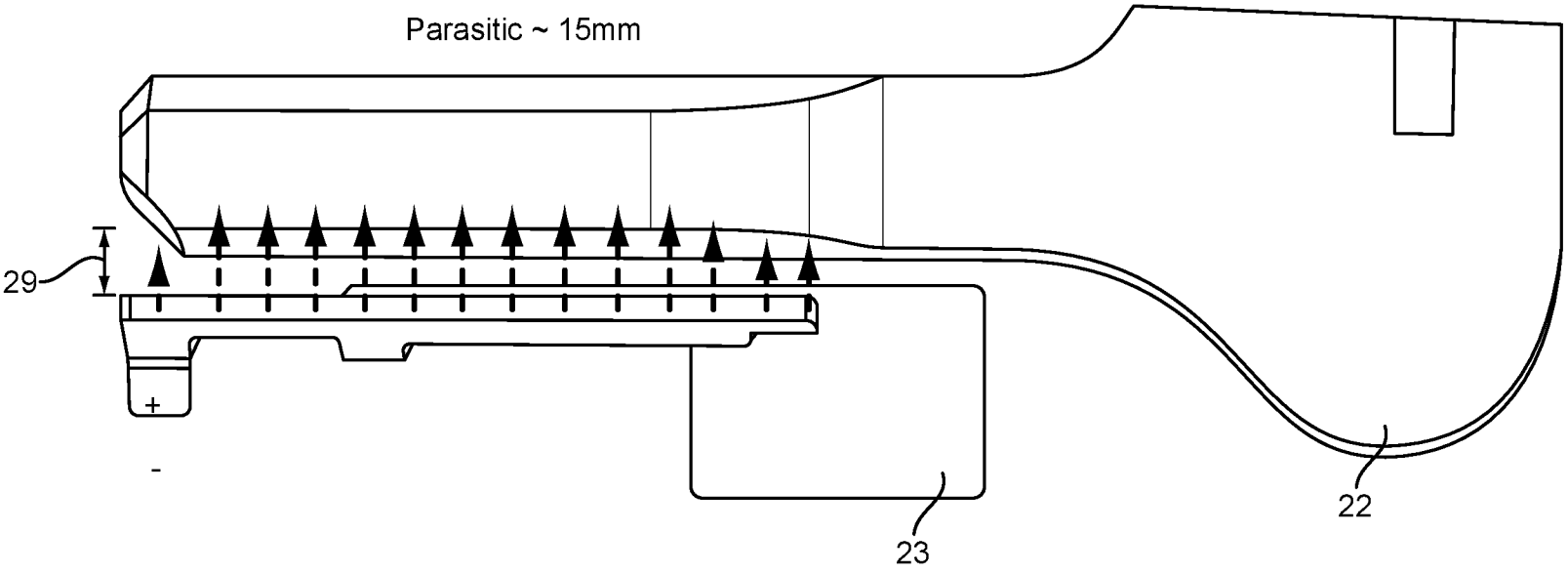
FIG. 7B is a top perspective view of the antenna of FIG. 2 illustrating the current flow when both the high frequency element and low frequency loop are radiating.

FIGS. 7A-B provide a side view and a top view, respectively, of the current flow at a lower frequency band. This lower frequency current flow occurs when both the high frequency element 23 and the lower frequency band current loop, (e.g. 2.4 GHz loop) are radiating. Essentially a loop antenna is created because collectively, the 15 mm of the high frequency element 23, the 15 mm of the parasitic element 22, the 15 mm return path on the ground plane 25, and the capacitive loading between the parasitic element 22 and the high frequency element 23, all add up to the effective 60 mm electric loop (half the wavelength at 2.4 GHz). As similarly depicted in FIG. 6, the longer solid arrows depict portions of the current loop where the current is stronger, and the weaker currents are indicated by shorter arrows. In FIG. 7B, a top view of the antenna 20 is provided depicting the current flow across the coupling gap 29. The dashed arrows illustrate stronger electric fields. The electric field is the mechanism by which the high frequency element 23 and the parasitic element 22 couple to form an electrically continuous current path for the lower frequency band.

Wireless Device Application and Method of Manufacture

The present invention includes embodiments of wireless devices and manufacturing of such wireless devices that employ embodiments of the antennas described above. An exemplary wireless device is a compact wireless device which may include a number of components within a housing (e.g., a casing, enclosure, etc.). The embodiments of the antennas described herein can be adapted and configured to fold into the shape, size and/or form factor of the housing of the wireless device. As a result, the antenna may take on a corresponding shape of the housing or other desired shape, such as a ring, cylinder, or polygon (e.g., hexagon, prism, rectangle, square, etc.).

Figure 8:
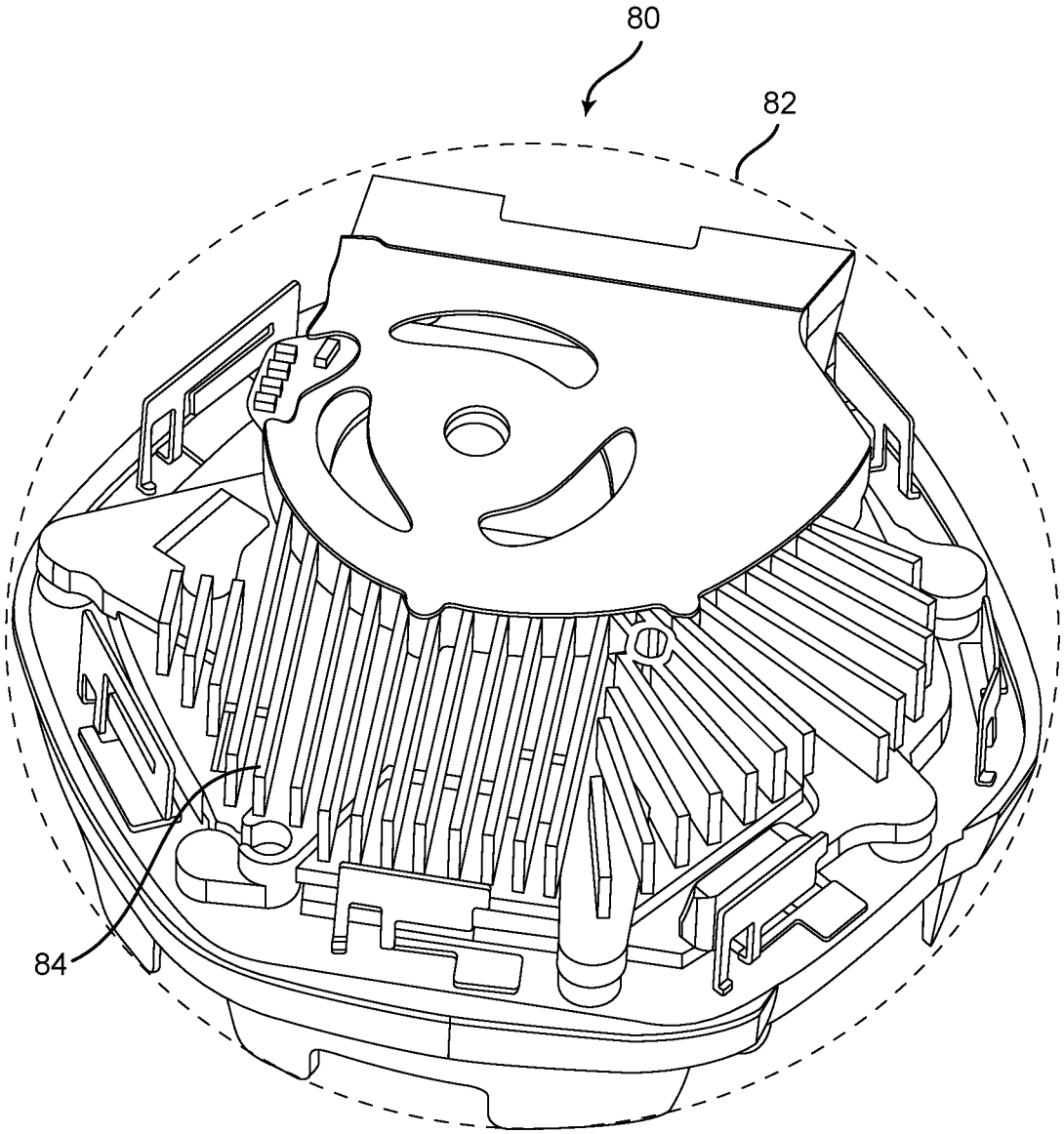
FIG. 8 is a perspective view of an embodiment of a wireless device utilizing an embodiment of the dual band antenna of the present disclosure.

FIG. 8 is a perspective view of an embodiment of a wireless device 80 utilizing an embodiment of the dual band antenna 20 of the present disclosure. The wireless device 80 may have a wall plug 8 that extends out of the housing 82, for insertion into an electrical wall outlet, for example. As will be understood by those of ordinary skill in the art, the housing 82 is illustrated using hashed lines, so as to more easily depict the one or more components 84 within the wireless device 80. The one or more components 84 may also include heatsinks, fan modules, printed circuit boards, processor(s), a plurality of radios, a local interface, a data store, a network interface, power etc. It should be appreciated by those of ordinary skill in the art that FIG. 8 depicts the wireless device 80 in a simplified manner, and an alternate embodiments may include additional components therein that are suitably configured for processing logic to support features described herein or known or conventional operating features that are not described in detail herein. For example, a processor can be any custom made or commercially available processor, a central processing unit (CPU), an auxiliary processor among several processors, a semiconductor-based microprocessor (in the form of a microchip or chip set), or generally any device for executing software instructions. The processor may be configured to execute software stored within memory to generally control operations pursuant to software instructions. In an exemplary embodiment, a processor may include a mobile-optimized processor such as optimized for power consumption and mobile applications.

Method(s) for manufacturing a wireless device 80 are also provided. The method includes providing one or more components disposed within a housing 82 of the wireless device 80; and providing at least one antenna 20 disposed within the housing 82. As will be understood by those of ordinary skill in the art, a plurality of dual-band antennas 20 according to the embodiments provided herein may be provided within a single wireless device 80. The method may include the step of stamping or molding the parasitic element 22 according to the dimensions disclosed above. One of the benefits and advantages of the antenna 20 of the instant application is that in one embodiment the antenna 20 may completely assembled separately from the wireless device 80. In FIG. 3B, the antenna 20 refers to the 5G antenna element 23 and the parasitic element 22. Once the antenna element 20 is constructed, it can be secured by screwing, connecting, clipping or otherwise mechanically securing the antenna 20 within a housing 82 of the wireless device 80. As such, in an embodiment, the high frequency element 23 is SMT'ed on a PCB, while the parasitic element 22 may be grown out of a heatsink and attached to ground 25 by a screw.

Figure 9:
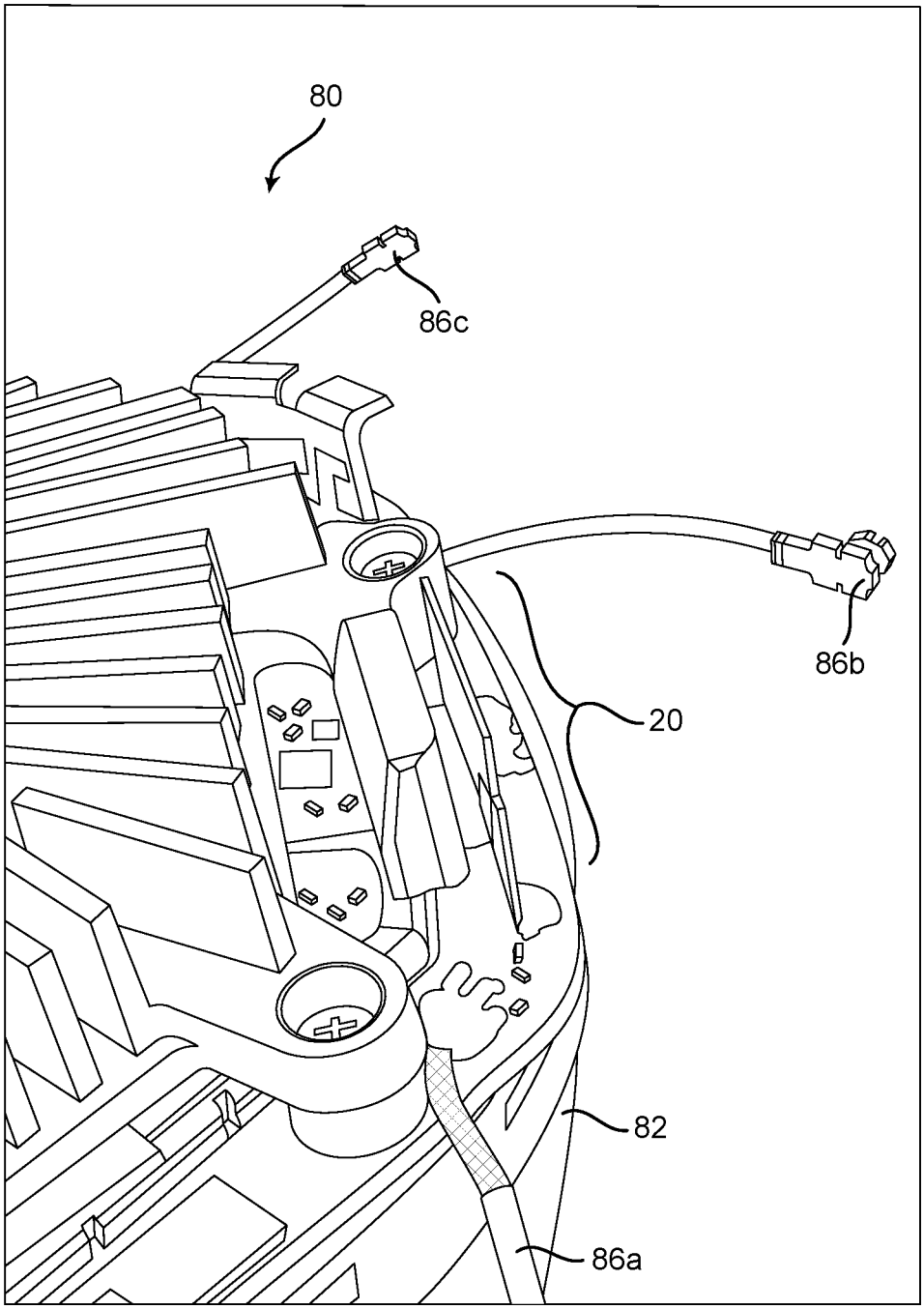
FIG. 9. is a zoomed in illustration of a portion of the wireless device of FIG. 8 having antenna cables that have been wired and soldered to the antenna according to an embodiment of the present disclosure.
Figure 10:
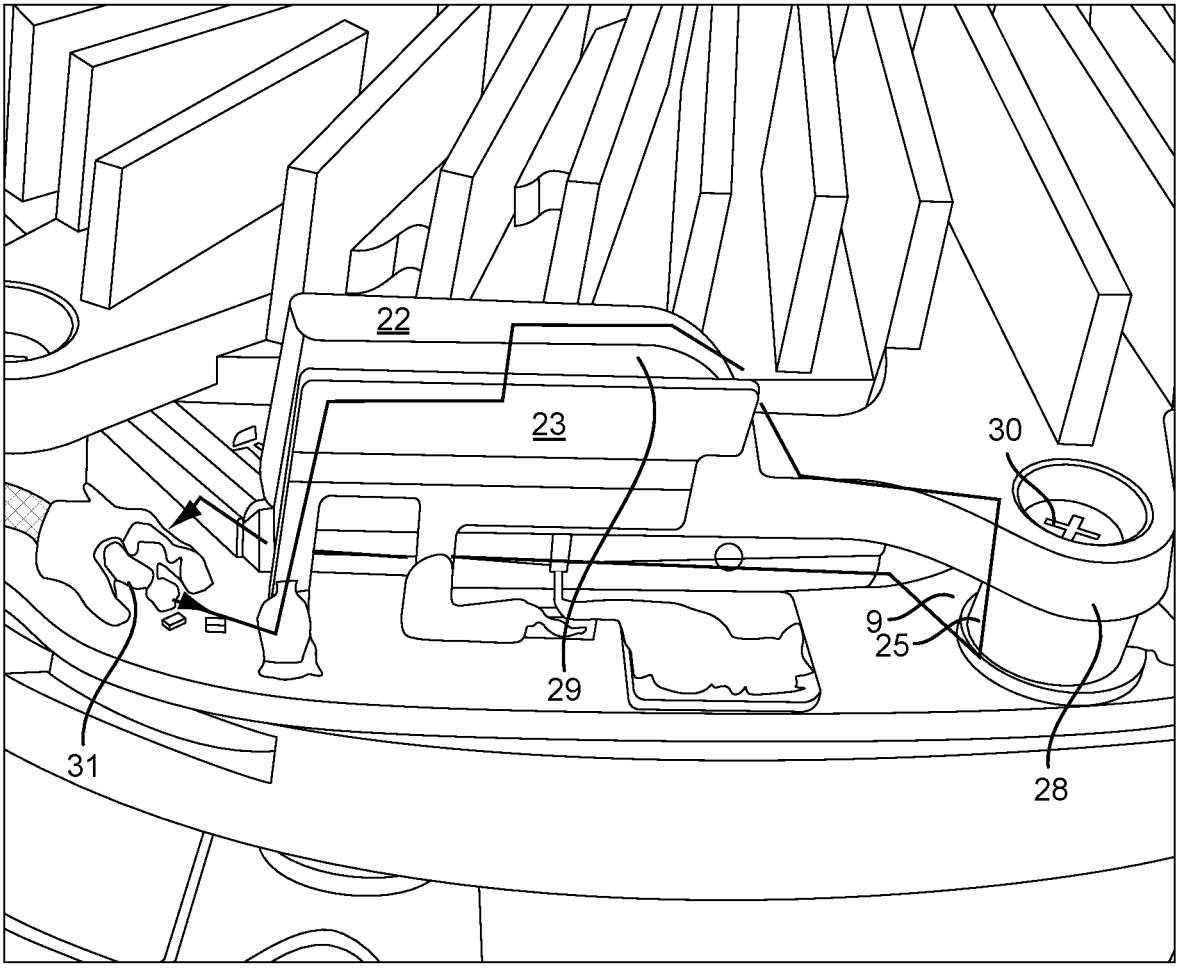
FIG. 10 is an alternative view of a portion of the wireless device of FIG. 8, the arrow tracing the low frequency current loop of an antenna in operation according to an embodiment of the present disclosure.

FIGS. 9-10 are zoomed in illustrations of a portion of the wireless device 80 of FIG. 8. In FIG. 9. antenna cables 86*a-c* are provided that have been wired and soldered to the antenna 20 according to an embodiment of the present disclosure. The antenna cables 86*a-c* may be provided merely to test the antenna embodiments in the wireless device 80 and are not needed for the wireless device 80 to function. FIG. 10 is yet another view of a portion of the wireless device 80 of FIG. 8. The arrow depicted traces the current loop 9 of the low frequency band (2.4 GHz) when the wireless device 80 is in operation, according to an embodiment of the present disclosure. The current loop 9 starts at contact point 31 at a plus (+) end (e.g. positive end of an RF connector), and travels through an RF trace (not shown) to the high frequency element 23. The high frequency element 23 couples to the parasitic element 22, and the current travels across the coupling gap 29 to the parasitic element 22. From the parasitic element 22, the current loop 9 continues through the metallic fastener 30 within the connector 28 to the ground plane 25, and then back towards the contact point 31 at the minus (−) end (e.g., negative end of an RF connector).

Figure 11A:
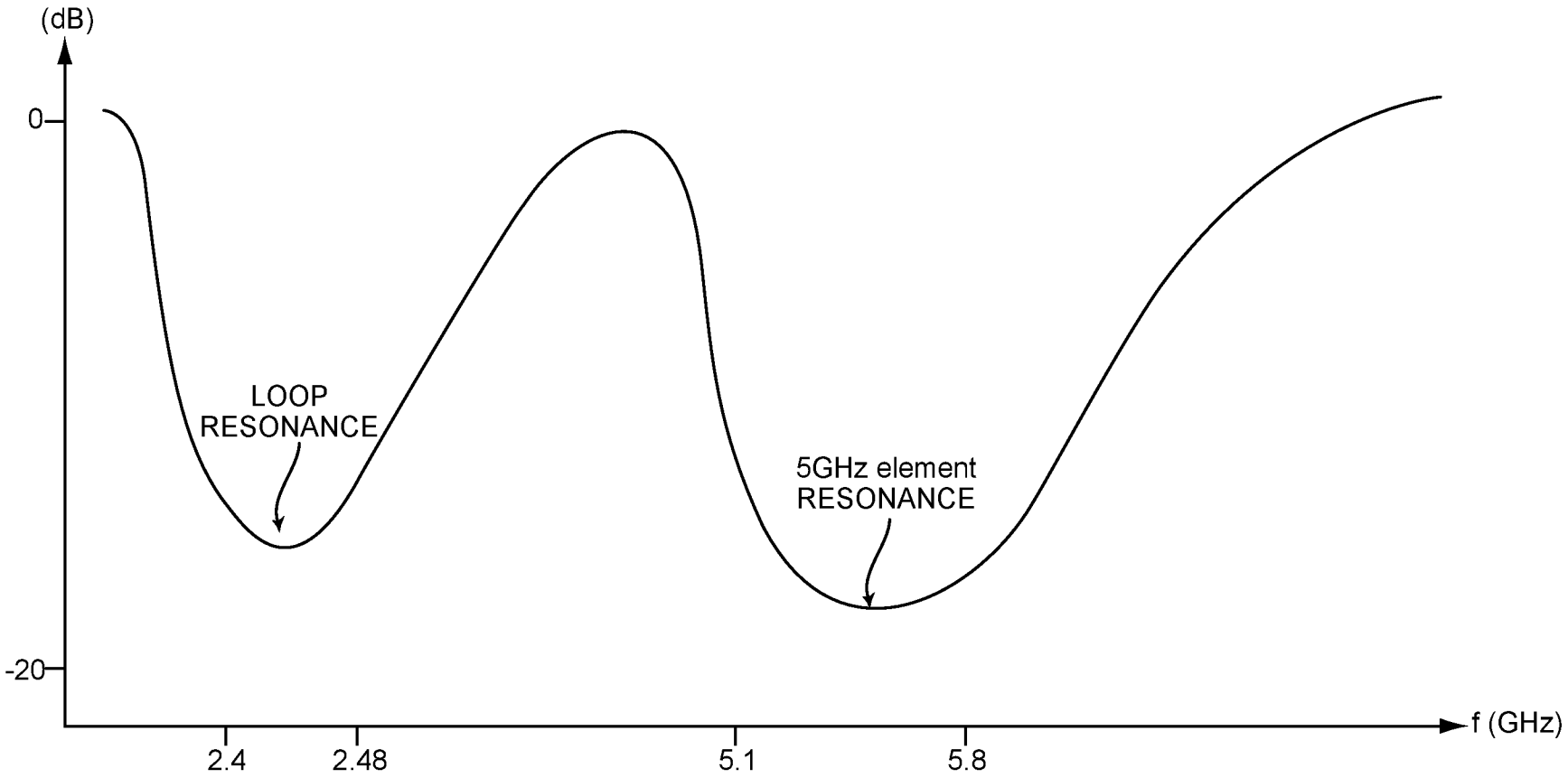
FIG. 11A-C are graphs illustrating the tuning, efficient and coupling of an exemplary embodiment of an antenna in operation of the present disclosure.
Figure 11B:
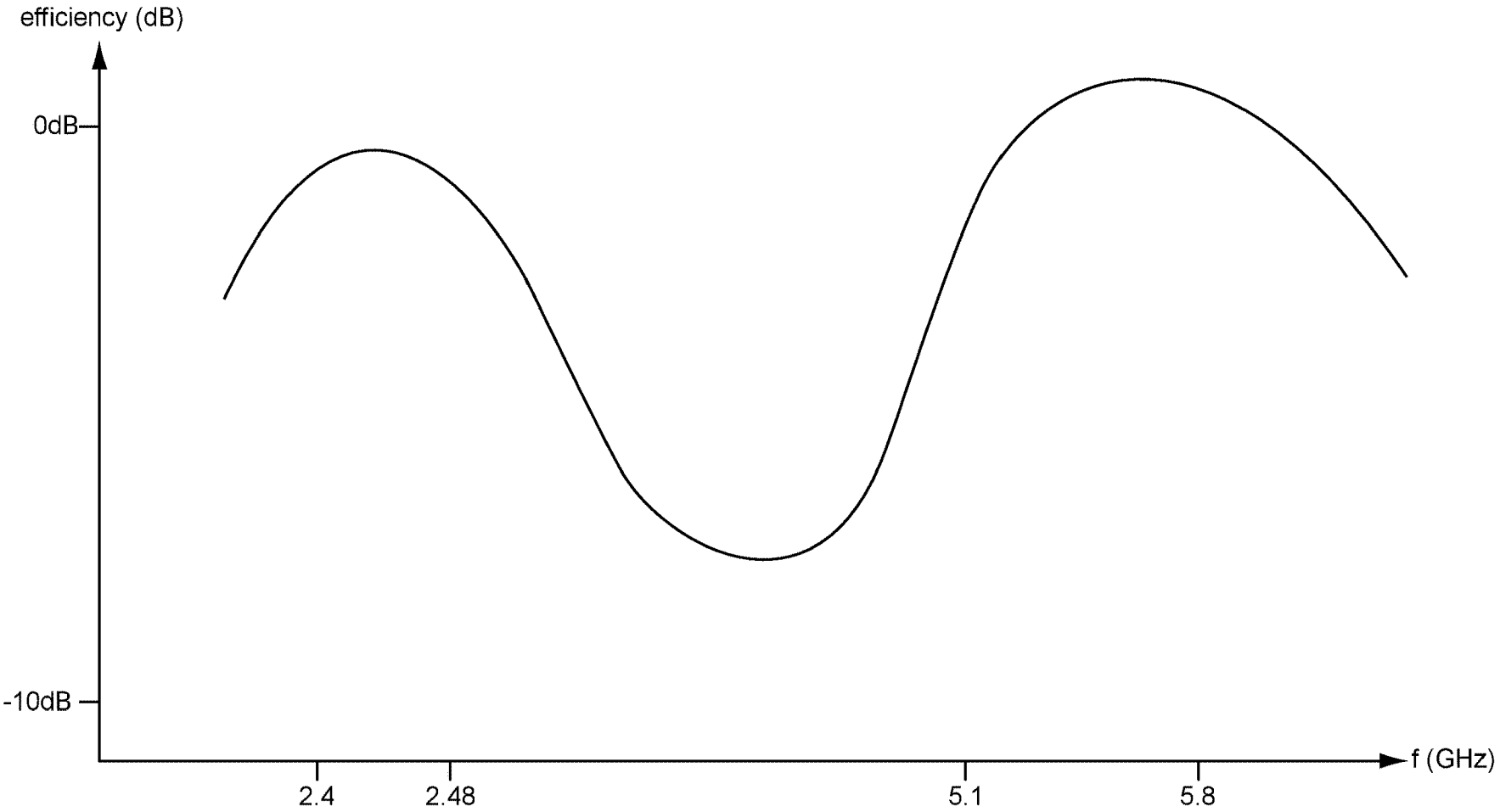
Figure 11C:
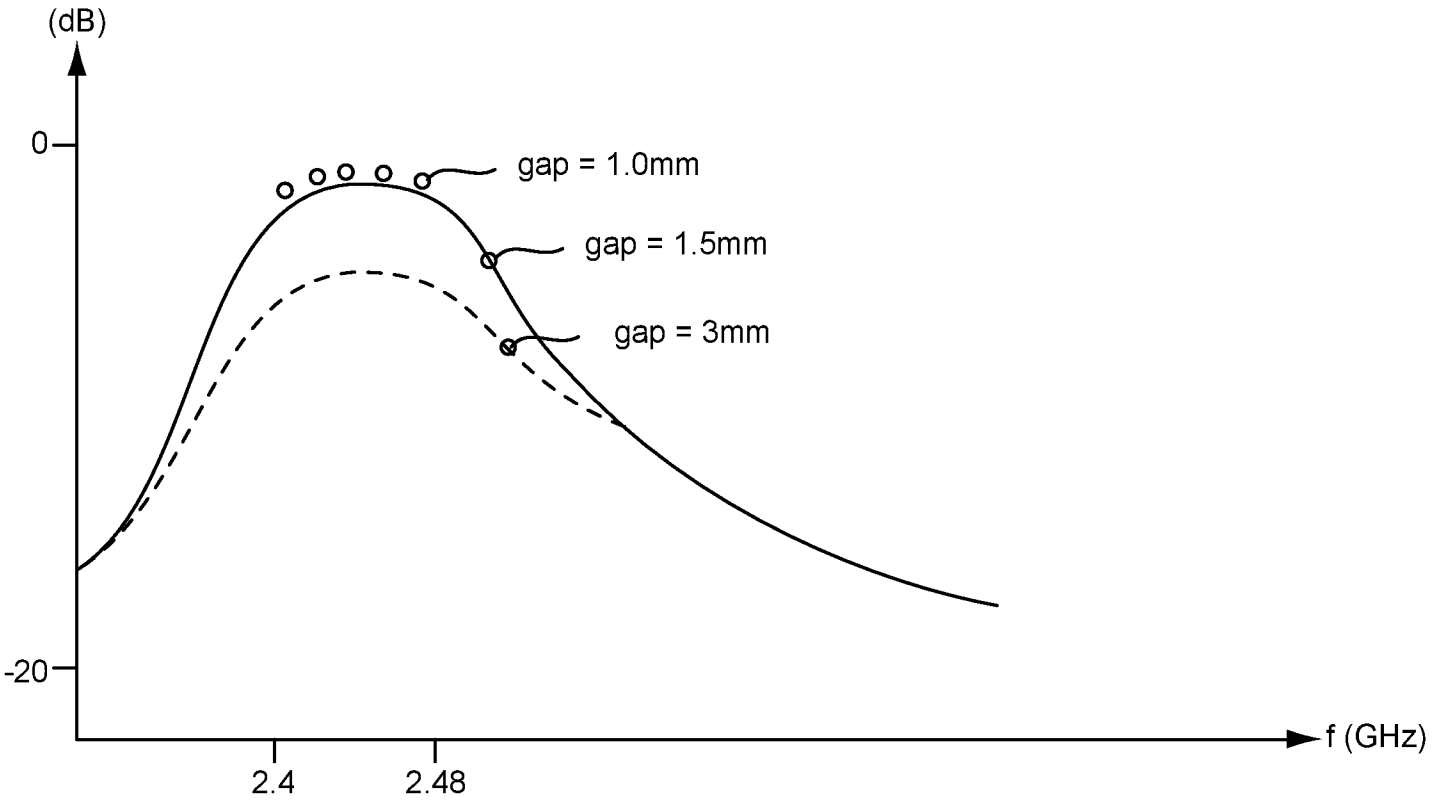

FIGS. 11A-C are graphs of the exemplary tuning, efficient and coupling of the antenna element in operation within a wireless device. FIG. 11A illustrates the two resonant frequencies of the antenna 20. In an embodiment, the low frequency band resonance is between 2.4 and 2.48 GHz, and the high frequency band resonance is between 5.1 to 5.8 GHz. The 2.4-2.48 GHz resonance is due to the loop current, while the 5.1-5.8 are due to 5 GHz element/PIFA current. Similarly, in FIG. 11B illustrates an embodiment of the efficiency of the antenna 20 in which the 2.4-2.48 GHz resonance is due to the loop current, and the 5.1-5.8 is due to 5 GHz element/PIFA current. FIG. 11C is a graphical depiction of the coupling between the high frequency element 23 and the parasitic element 22 at three different lengths of a coupling gap 29. This graph shows that if the coupling gap 29 is about 1 mm, the coupling is almost 0 dB or 100%.

It will be appreciated that some exemplary embodiments of the wireless device described herein may include a variety of components such as one or more generic or specialized processors ("one or more processors") such as microprocessors; Central Processing Units (CPUs); Digital Signal Processors (DSPs): customized processors such as Network Processors (NPs) or Network Processing Units (NPUs), Graphics Processing Units (GPUs), or the like; Field Programmable Gate Arrays (FPGAs); and the like along with unique stored program instructions (including both software and firmware) for control thereof to implement, in conjunction with certain non-processor circuits, some, most, or all of the functions of the methods and/or systems described herein. Alternatively, some or all functions may be implemented by a state machine that has no stored program instructions, or in one or more Application Specific Integrated Circuits (ASICs), in which each function or some combinations of certain of the functions are implemented as custom logic or circuitry. Of course, a combination of the aforementioned approaches may be used. For some of the exemplary embodiments described herein, a corresponding device in hardware and optionally with software, firmware, and a combination thereof can be referred to as "circuitry configured or adapted to," "logic configured or adapted to," etc. perform a set of operations, steps, methods, processes, algorithms, functions, techniques, etc. on digital and/or analog signals as described herein for the various exemplary embodiments.

Moreover, some exemplary embodiments may include a non-transitory computer-readable storage medium having computer readable code stored thereon for programming a computer, server, appliance, device, processor, circuit, etc. each of which may include a processor to perform functions as described and claimed herein. Examples of such computer-readable storage mediums include, but are not limited to, a hard disk, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory), Flash memory, and the like. When stored in the non-transitory computer-readable medium, software can include instructions executable by a processor or device (e.g., any type of programmable circuitry or logic) that, in response to such execution, cause a processor or the device to perform a set of operations, steps, methods, processes, algorithms, functions, techniques, etc. as described herein for the various exemplary embodiments.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A dual-band antenna comprising:

a ground plane functioning as a heat sink;

a molded parasitic element electrically connected to the ground plane, the parasitic element being part of the heat sink, wherein a first width of the parasitic element is larger at a first end relative to a second width of the parasitic element at a second end; and a high frequency element for resonating at a high frequency band and connected to the ground plane via a short, the high frequency element configured as an inverted F antenna, wherein the high frequency element is capacitively coupled to the parasitic element forming a loop antenna that resonates at a low frequency band;

wherein the high frequency band is in 5-6 GHz range, and the low frequency band is in 2-3 GHz range.

2. The dual-band antenna of claim 1, wherein the inverted F antenna has a portion such that a width of the portion is greater than ¼ of a length of the portion.

3. The dual-band antenna of claim 1, wherein the parasitic element is formed from one of a shield can, part of the heat sink, an enclosure, and a stamped metallic sheet.

4. The dual-band antenna of claim 1, in which the loop antenna comprises a mechanical connection to the ground plane.

5. The dual-band antenna of claim 1, in which the parasitic element is manufactured as a separate component.

6. A wireless device having a housing, the wireless device comprising:

a heat sink; and at least one dual-band antenna comprising:

a high frequency element that resonates in a high frequency band, the high frequency element configured as an inverted F antenna; and a molded parasitic element capacitively coupled to the high frequency element forming a current loop, the parasitic element being part of the heat sink, wherein a first width of the parasitic element is larger at a first end relative to a second width of the parasitic element at a second end;

wherein the current loop resonates at a low frequency band;

wherein the high frequency band is in 5-6 GHz range, and the low frequency band is in 2-3 GHz range.

7. The wireless device of claim 6, further comprising at least one device component that is one of a fan module and a printed circuit board.

8. The wireless device of claim 6, wherein a portion of the inverted F antenna has a width that is greater than ¼ of a length of the portion.

9. A method for manufacturing a wireless device, the method comprising:

providing a heat sink disposed within a housing of the wireless device, and providing at least one antenna element disposed within the housing, the at least one antenna element having a molded parasitic element and a high frequency element, the parasitic element being part of the heat sink, wherein a first width of the parasitic element is larger at a first end relative to a second width of the parasitic element at a second end, wherein the high frequency element is an inverted F antenna that resonates at a high frequency band, and the high frequency element is capacitively coupled to the parasitic element forming a current loop that resonates at a low frequency band;

wherein the high frequency band is in 5-6 GHz range, and the low frequency band is in 2-3 GHz range.

10. The method of claim 9, wherein the step of providing the at least one antenna element comprises manufacturing the parasitic element as a separate component.

* * * * *